US010336577B2

(12) United States Patent
Witczak et al.

(10) Patent No.: US 10,336,577 B2
(45) Date of Patent: Jul. 2, 2019

(54) BRAKING SYSTEM FOR AN ELEVATOR SYSTEM

(71) Applicant: Otis Elevator Company, Farmington, CT (US)

(72) Inventors: Tadeusz Pawel Witczak, Bethel, CT (US); Zbigniew Piech, Cheshire, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 307 days.

(21) Appl. No.: 15/157,915

(22) Filed: May 18, 2016

(65) Prior Publication Data

US 2017/0334679 A1 Nov. 23, 2017

(51) Int. Cl.

| | |
|---|---|
| ***B66B 5/16*** | (2006.01) |
| ***B66B 9/00*** | (2006.01) |
| ***B66B 9/02*** | (2006.01) |

(52) U.S. Cl.

CPC ..... *B66B 5/16* (2013.01); *B66B 9/00* (2013.01); *B66B 9/02* (2013.01); *B66B 9/003* (2013.01)

(58) Field of Classification Search

CPC ..... B66B 5/16; B66B 9/00; B66B 9/02
See application file for complete search history.

(56) References Cited

U.S. PATENT DOCUMENTS

| | | | | |
|---|---|---|---|---|
| 4,047,597 | A * | 9/1977 | Okura | B66B 7/047 187/409 |
| 5,234,079 | A | 8/1993 | Nomura | |
| 5,566,784 | A * | 10/1996 | Rennetaud | B66B 9/02 187/249 |
| 5,984,053 | A * | 11/1999 | Lee | B66B 7/046 182/141 |
| 6,161,653 | A | 12/2000 | Skalski et al. | |
| 6,425,462 | B1 | 7/2002 | Tran et al. | |
| 7,575,099 | B2 | 8/2009 | Oh et al. | |
| 2003/0217893 | A1 * | 11/2003 | Dunser | B66B 1/2466 187/249 |
| 2006/0163008 | A1 | 7/2006 | Godwin | |
| 2008/0223666 | A1 | 9/2008 | Cuthbert | |
| 2012/0211311 | A1 * | 8/2012 | Piech | B66B 5/16 187/351 |
| 2013/0206514 | A1 | 8/2013 | Kim et al. | |
| 2015/0353321 | A1 | 12/2015 | Fargo | |

(Continued)

FOREIGN PATENT DOCUMENTS

| | | | |
|---|---|---|---|
| GB | 2402383 | A | 12/2004 |
| JP | H061558 | A | 1/1994 |

(Continued)

OTHER PUBLICATIONS

Zhang, Hongwei, "Condition Monitoring of Rope-less Elevator Braking System Based on Wavelet Denoising", Journal of Computers, vol. 8, No. 3, Mar. 2013, pp. 741-748.

*Primary Examiner* — Michael A Riegelman
(74) *Attorney, Agent, or Firm* — Cantor Colburn LLP

(57) ABSTRACT

An elevator system including a hoistway, an elevator car disposed in the hoistway, the elevator car including a first braking device configured to engage a first braking surface in a first direction in the event of a guidance occurrence, and a second braking device configured to engage a second braking surface in a second direction in the event of the guidance occurrence.

18 Claims, 4 Drawing Sheets

(56) References Cited

U.S. PATENT DOCUMENTS

| | | | | |
|---|---|---|---|---|
| 2015/0368071 | A1* | 12/2015 | Witczak | B66B 9/02 187/250 |
| 2016/0046464 | A1* | 2/2016 | Piech | B66B 9/003 187/249 |
| 2016/0083226 | A1* | 3/2016 | Piech | B66B 11/0407 187/250 |
| 2016/0090275 | A1* | 3/2016 | Piech | B66B 11/0226 187/250 |
| 2016/0236904 | A1* | 8/2016 | Witczak | B66B 5/22 |
| 2016/0297640 | A1* | 10/2016 | Witczak | B66B 1/2466 |
| 2016/0297648 | A1* | 10/2016 | Witczak | B66B 11/04 |
| 2016/0304316 | A1* | 10/2016 | Witczak | B66B 11/0407 |
| 2016/0304317 | A1* | 10/2016 | Witczak | B66B 11/04 |
| 2017/0057784 | A1* | 3/2017 | Witczak | B66B 7/02 |
| 2017/0057786 | A1* | 3/2017 | Witczak | B66B 7/046 |
| 2017/0190544 | A1* | 7/2017 | Witczak | B66B 1/2466 |
| 2017/0225924 | A1* | 8/2017 | Lau | B66B 1/30 |
| 2017/0355565 | A1* | 12/2017 | Hsu | B66B 3/00 |
| 2017/0355568 | A1* | 12/2017 | Schmidt | B66B 11/0407 |
| 2018/0009636 | A1* | 1/2018 | Jedryczka | B66B 9/003 |
| 2018/0029829 | A1* | 2/2018 | Piech | B66B 7/04 |
| 2018/0222722 | A1* | 8/2018 | Witczak | B66B 9/003 |

FOREIGN PATENT DOCUMENTS

| | | | | |
|---|---|---|---|---|
| JP | H0632548 | A | | 2/1994 |
| JP | 09202558 | A | * | 8/1997 |
| WO | 2008136692 | A2 | | 11/2008 |
| WO | 2015047391 | A1 | | 4/2015 |

* cited by examiner

BRAKING SYSTEM FOR AN ELEVATOR SYSTEM

TECHNICAL FIELD OF THE DISCLOSED EMBODIMENTS

The present disclosure is generally related to elevator systems and, more specifically, a braking system for an elevator system.

BACKGROUND OF THE DISCLOSED EMBODIMENTS

Elevator systems are widely used in a variety of applications for transporting passengers from one point to another. In rare situations, such as during earthquakes, the elevator car in an elevator system may become disengaged with the rails. Typical contemporary elevator systems often include redundant braking (e.g. machine brake and safeties) for such situations. As such, increased requirements for elevators systems include rail to building interface and elevator car holding/braking systems. These additional requirements increase the overall cost of the system by adding mass to the elevator car, and potentially changing motor requirements.

Therefore, an improved braking system for an elevator system is desired.

SUMMARY OF THE DISCLOSED EMBODIMENTS

In one aspect, an elevator system is provided. The elevator system includes a hoistway comprising a hoistway structure, and an elevator car disposed in the hoistway. The elevator car includes a first braking device configured to engage a first braking surface in a first direction in the event of a guidance occurrence, and a second braking device configured to engage a second braking surface in a second direction in the event of the guidance occurrence. In an embodiment, the first direction is opposite of the second direction.

In an embodiment, the elevator system further includes a guidance structure disposed in the hoistway, and the elevator car further includes at least two guiding devices disposed on the elevator car, and configured to engage the guide structure and thereby direct the course of travel of the elevator car. In an embodiment, the guidance occurrence includes at least one of the guiding devices becomes disengaged with the guidance structure, failure of the guidance structure, and the elevator car rotating beyond a guidance limit.

In an embodiment, the first braking device is operably coupled to at least one side of the elevator car adjacent to the first braking surface, and the second braking device is operably coupled to at least one side of the elevator car adjacent to the second braking surface. In an embodiment, the first braking device includes at least one of a retainer member, and a braking pad disposed on the retainer member. In an embodiment, the first braking device is disposed on at least one of an upper portion and a lower portion of the elevator car. In an embodiment, the second braking device includes at least one of a retainer member, a braking pad disposed on the retainer member, and a braking pad. In an embodiment, the second braking device is disposed on at least one of an upper portion and a lower portion of the elevator car.

In an embodiment, the first braking surface includes at least one of a first side of the guidance structure and the hoistway structure. In an embodiment, the second braking surface includes at least one of the first side of the guidance structure, a second side of the guidance structure, and the hoistway wall, wherein the second side is opposite of the first side, In an embodiment, the at least two guiding devices are disposed on opposite sides of the elevator car. In another embodiment, the at least two guiding devices are disposed on the same side of the elevator car. In an embodiment, the at least two guiding devices includes a first propulsion device. In an embodiment, the second braking device is operably coupled to the first propulsion device. In an embodiment, the at least two guiding devices includes a second propulsion device disposed in the hoistway, wherein the second propulsion device is configured to engage the first propulsion device to direct movement of the elevator car. In an embodiment, the second braking surface comprises the second propulsion device.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
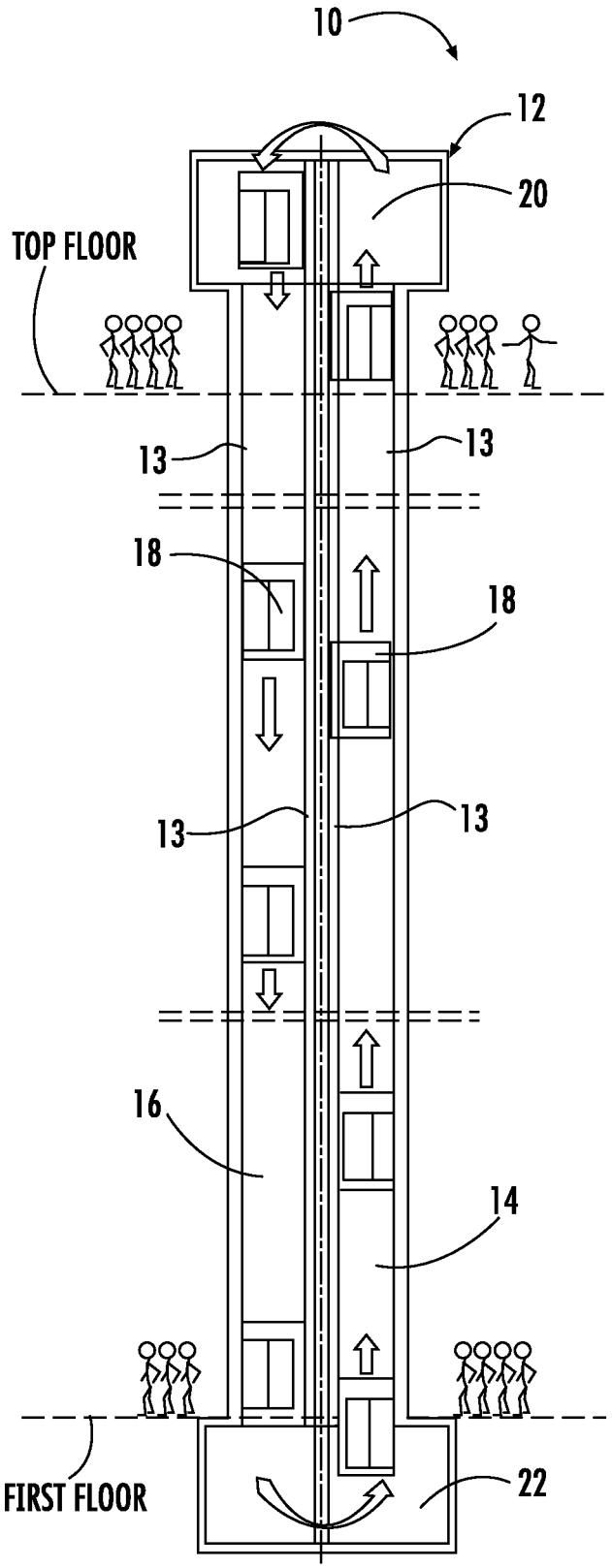
FIG. 1 is a schematic diagram of an exemplary elevator system, constructed in accordance with an aspect of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Referring now to FIG. 1, an elevator system 10 is shown in schematic fashion. It is to be understood that the exemplary version of the elevator system 10 shown in FIG. 1 is for illustrative purposes only and to present background for the various components of a general elevator system.

As shown in FIG. 1, the elevator system 10 comprises a hoistway 12 that includes a first hoistway portion 14 and a second hoistway portion 16. The first and second hoistway portions 14, 16 may each be disposed vertically within a multi-story building. The first and second hoistway portions 14, 16 may be dedicated to directional travel. In some embodiments, the first and second hoistway portions 14, 16 may be part of a single open hoistway 12. In other embodiments, the first and second hoistway portions 14, 16 may be part of a divided hoistway 12 that has a hoistway structure 13 (e.g. wall or other divider to name a couple of non-limiting examples) between the first and second hoistway portions 12, 16. The hoistway 12 is not limited to two hoistway portions. In some embodiments, the hoistway 12 may include a single hoistway or more than two hoistway portions disposed vertically within a multi-story building.

In the embodiment illustrated in FIG. 1, elevator cars 18 may travel upward in the first hoistway portion 12. Elevator cars 18 may travel downward in the second hoistway portion 16. Elevator system 10 transports elevator cars 18 from a first floor to a top floor in the first hoistway portion 14 and transports elevator cars 18 from the top floor to the first floor in the second hoistway portion 16. Above the top floor is an upper transfer station 20 where elevator cars 18 from the first hoistway portion 14 are moved to the second hoistway portion 16 as described in further detail herein. It is understood that the upper transfer station 20 may be located at the top floor, rather than above the top floor. Below the first floor is a lower transfer station 22 where elevator cars 14 from the second hoistway portion 16 are moved to the first hoistway portion 14. It is understood that lower transfer station 22 may be located at the first floor, rather than below the first floor. Although not shown in FIG. 1, elevator cars 18 may stop at intermediate floors to allow ingress to and egress from an elevator car 18.

Figure 2:
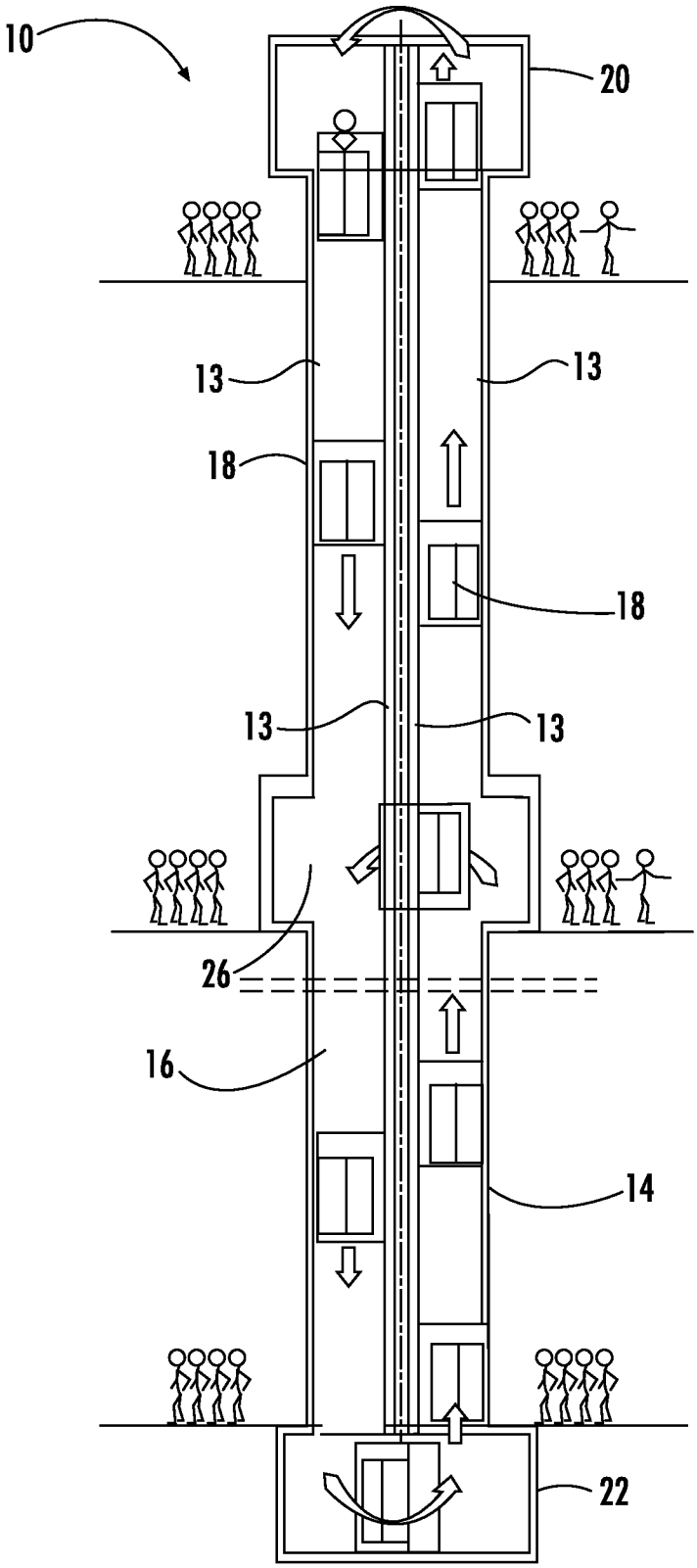
FIG. 2 is a schematic diagram of an exemplary elevator system, constructed in accordance with an aspect of the present disclosure.

FIG. 2 depicts another exemplary embodiment of the elevator system 10. In this embodiment, the elevator system 10 includes an intermediate transfer station 26 located between the first floor and the top floor where the elevator car 18 may be moved from the first hoistway portion 14 to the second hoistway portion 16 and vice versa. Although a single intermediate transfer station 26 is shown, it is understood that more than one intermediate transfer station 26 may be used. Such an intermediate transfer may be utilized to accommodate elevator calls. For example, one or more passengers may be waiting for a downward traveling car 18 at a landing on a floor. If no cars 18 are available, an elevator car 18 may be moved from the first hoistway portion 14 to the second hoistway portion 16 at intermediate transfer station 26 and then moved to the appropriate floor to allow the passenger(s) to board. It is noted that elevator cars 18 may be empty prior to transferring from one hoistway portion to another at any of the upper transfer station 20, lower transfer station 22, or intermediate transfer station 26.

Figure 3:
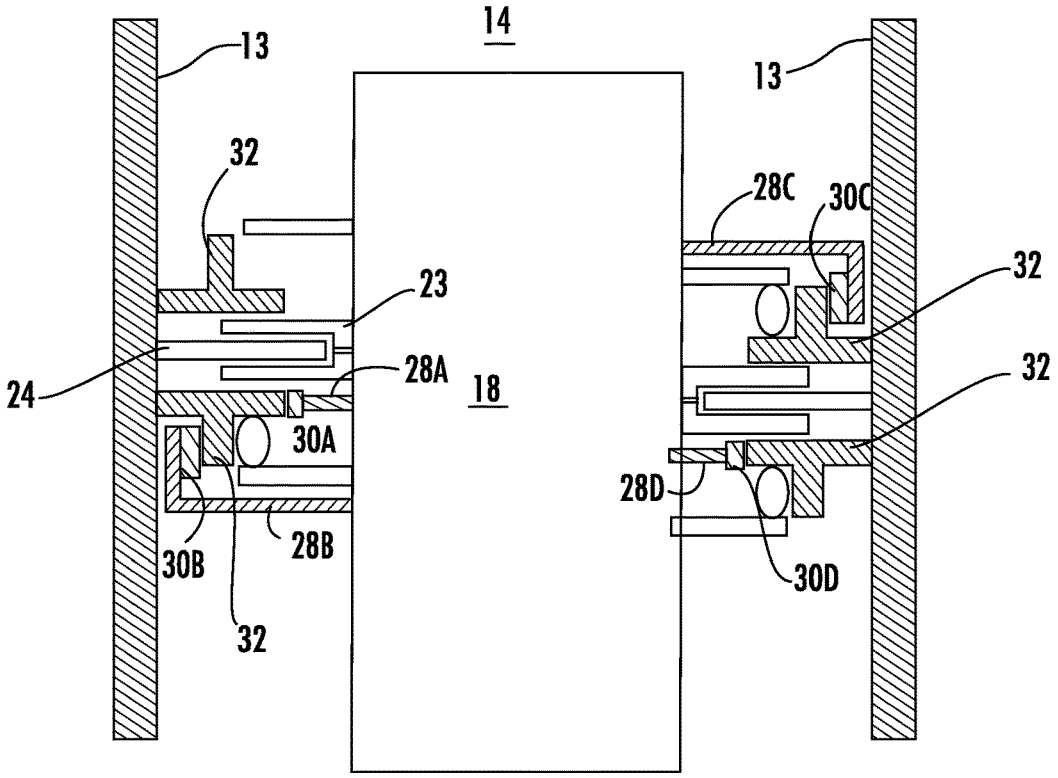
FIG. 3 is a schematic diagram of a top view of a braking system in accordance with an aspect of the present disclosure.

FIG. 3 depicts a top view of the elevator car 18 in an exemplary embodiment of the elevator system 10. The elevator car 18 is depicted in the first hoistway portion 14, but may be in any hoistway portion within the hoistway 12.

The elevator system 10 further includes a mover 23 and a stationary stator 24 (i.e. propulsion structures). In one embodiment, at least one mover 23 is mounted on each elevator car 18 disposed in each hoistway 12. In one embodiment, the mover 23 may include a plurality of magnets (not shown, e.g., permanent magnets, electromagnets). The stationary stator 24 may be mounted on a support column or on a sidewall of the hoistway 12. In the exemplary elevator system 10, a stationary stator 24 is mounted generally vertically in each hoistway portion 14, 16. The stationary stator 24 may include a plurality of coils of wire (not shown) operably connected to a source of electricity (not shown).

In some embodiments, the elevator system 10 may further include a transfer stator (not shown). Similar to the stationary stator 24, the transfer stator may also include a plurality of coils of wire (not shown) operably connected to the source of electricity (not shown). The transfer stator may be moveable from a first position in the first hoistway portion 14 to a second position in the second hoistway portion 16.

In operation, the interaction of the mover 23 and the stator 24 generates a thrust that propels the elevator car 18 (attached to the mover 23). For example, in one embodiment, the mover 23 (and the elevator car 18 attached to the mover 23) is propelled vertically when the coils of wire of the stator 24 adjacent to the mover 23 are energized. In an embodiment, the mover 23 and the stator 24 are disposed on opposite sides of the elevator car 18. In other embodiments, the mover 23 and the stator 24 are disposed on the same side of the elevator car 18.

In an embodiment, one or more retainer members 28A, 28B, 28C and 28D (generically referred to as retainer member 28) is operably coupled to at least one side of the elevator car 18. The retainer member 28 is configured to travel with the elevator car 18 within either the first and second hoistway portions 14, 16. It will be appreciated that the retainer member 28 may be attached to a portion of the guidance structure, a portion of the propulsion structure, or to the elevator car frame to name a few non-limiting examples.

Figure 4:
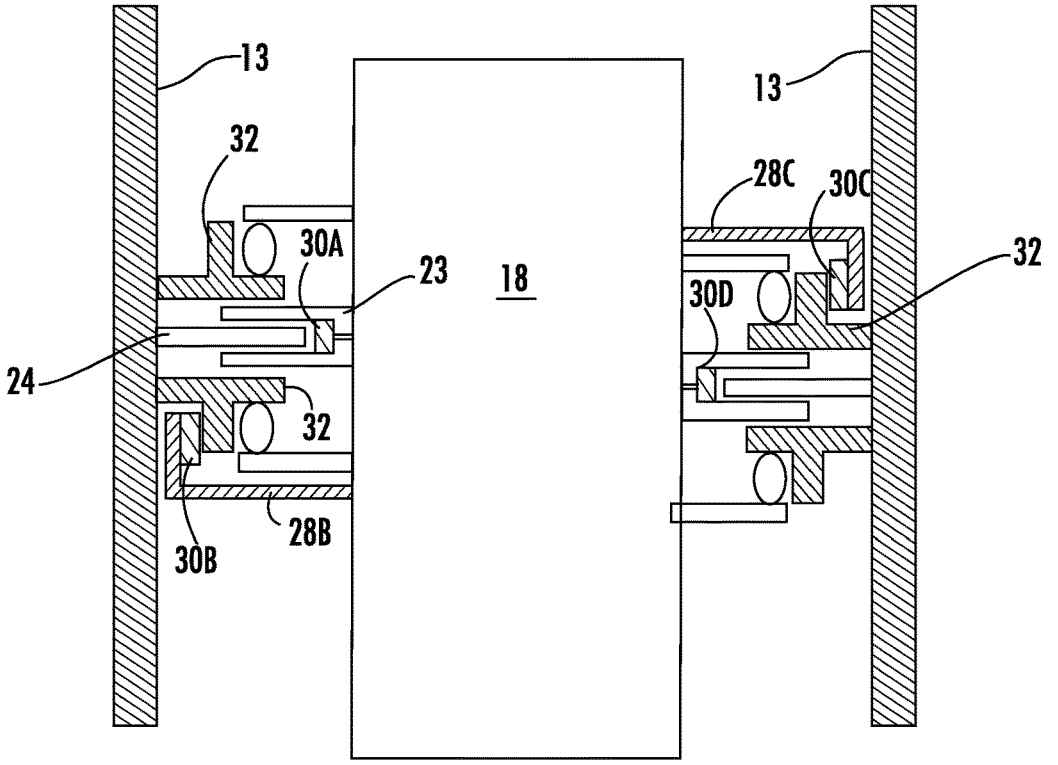
FIG. 4 is a schematic diagram of a top view of a braking system in accordance with an aspect of the present disclosure.

Each retainer member 28 includes a braking pad 30A, 30B, 30C and 30D (generically referred to as retainer member 30) disposed thereon. In some embodiments, the braking pad 30 may be composed of friction based materials, such as soft rubbers or polymers to name a couple of non-limiting examples. In some embodiments, the braking pad 30 may be composed of metallic braking compounds. In some embodiments, as shown in FIG. 4, the braking pad 30 may be affixed to a portion of the guidance structure or a portion of the propulsion structure. It will be appreciated that the brake pads 30 may be formed in any shape.

In some embodiments, a spring device (not shown) may be attached between the retainer member 28 and the braking pad 30. The spring device is configured to act as a dampener; thus, providing less force on the braking pad 30 in actuation. For example, if the elevator car 18 is empty (i.e., carrying less mass) the spring device may be slightly compressed to provide a braking force less than the maximum available force, such as in situations where the elevator car 18 is full. In such situations, the spring device may be completely compressed to provide the maximum available force against the braking pad 30 to stop the elevator car 18.

Figure 5:
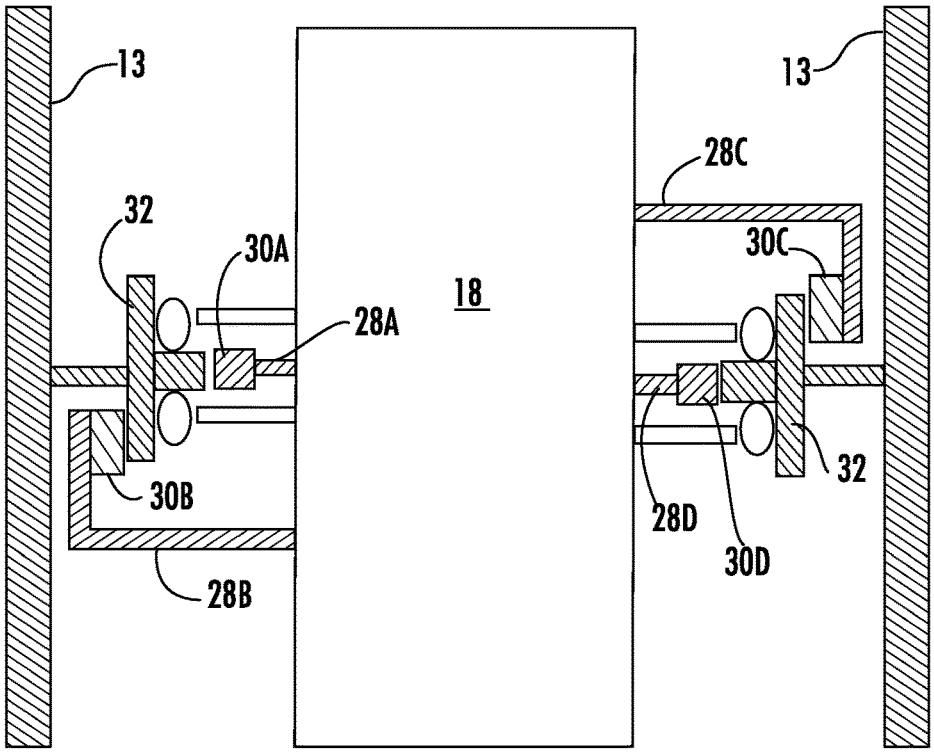
FIG. 5 is a schematic diagram of a top view of a braking system in accordance with an aspect of the present disclosure.

In the embodiment shown in FIGS. 3-5, retainer members 28A, 28B are disposed on one side of the elevator car 18, each including a braking pad 30A, 30B, respectively. Retainer member 28A may be positioned on an upper portion of the elevator car 18, and retainer member 28B may be positioned on a lower portion of the elevator car 18. It will be appreciated that the retainer member 28A may be positioned on a lower portion of the elevator car 18, and retainer member 28B may be positioned on an upper portion of the elevator car 18. Braking pad 30A may be positioned on one side of the guidance structure 32 (e.g. a side of the guide rail near the hoistway wall) and braking pad 30B may be positioned on the opposite side of the guidance structure 32 (e.g. a side of the guide rail near the elevator car 18).

Retainer members 28C, 28D are disposed on the other side of the elevator car 18, with each including a braking pad 30C, 30D, respectively. Retainer member 28C may be positioned on an upper portion of the elevator car 18, and retainer member 28D may be positioned on a lower portion of the elevator car 18. It will be appreciated that the retainer member 28C may be positioned on a lower portion of the elevator car 18, and retainer member 28BD may be positioned on an upper portion of the elevator car 18. Braking pad 30C may be positioned on one side of the guidance structure 32 (e.g. a side of the guide rail near the hoistway structure 13) and braking pad 30D may be positioned on the opposite side of the guidance structure 32 (e.g. a side of the guide rail near the elevator car 18).

Figure 6:
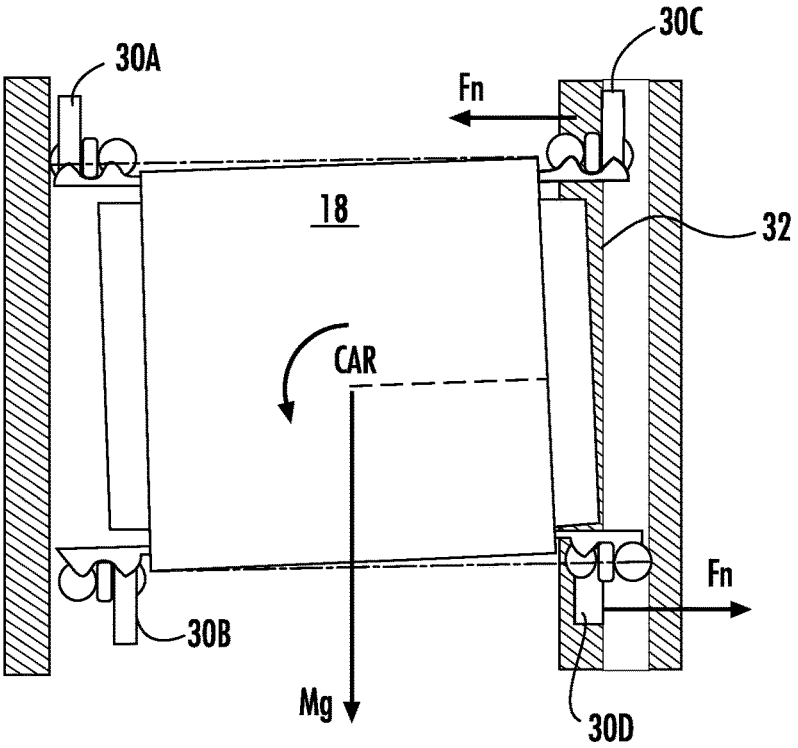
FIG. 6 is a schematic diagram of a side view of an engaged braking system in accordance with an aspect of the present disclosure.

In rare instances (e.g., earthquakes), the elevator car 18 may experience a guidance occurrence. In an embodiment, a guidance occurrence includes at least one of the guiding devices becomes disengaged with the guidance structure, failure of the guidance structure, and the elevator car 18 rotating beyond a guidance limit. In one of these occurrences, as shown in FIG. 6, the elevator car 18 experiences a moment $M_g$ causing it to turn in a direction toward the side of the elevator car 18 still engaged with the guidance structure 32 (e.g. guide rail). Because the typical braking system may not able to engage the guidance structure 32, the braking pads 30C, 30D operate as a safety brake by wedging against the guidance structure 32 with a force Fn, in opposite directions, capable of stopping the elevator car 18. In essence, braking pad 30C acts as a pulling brake against the guidance structure 32, and braking pad 30D acts as a pushing brake against the guidance structure 32, causing the elevator car 18 to stop.

In other embodiments, braking pad 30A and braking pad 30B may be positioned on the same side of the guidance structure 32 (e.g. a side near the hoistway structure 13 or a side near the elevator car 18). In such a configuration the braking pads 30A or 30B may engage the guidance structure 32, the hoistway structure 13 (e.g. wall), or both. Braking pad 30C and braking pad 30D may also be positioned on the same side of the guidance structure 32 (e.g. a side near the hoistway structure 13 or a side near the elevator car 18). In such a configuration the braking pads 30C or 30D may engage the guidance structure 32, the hoistway structure 13 (e.g. wall), or both.

It will therefore be appreciated that the present elevator system 10 includes an retainer member 28, including a braking pad 30 disposed thereon, that is able to act as a safety braking device in the event the elevator car 18 experiences a guidance occurrence.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. An elevator system comprising:

a hoistway; and an elevator car disposed in the hoistway, the elevator car comprising:

a first braking device configured to engage a first braking surface in a first direction in the event of a guidance occurrence; and a second braking device configured to engage a second braking surface in a second direction in the event of the guidance occurrence;

wherein in the event of the guidance occurrence, the first braking surface and the second braking surface configured to limit rotation of the elevator car.

2. The elevator system of claim 1, wherein the hoistway comprises a hoistway structure, and the elevator system further comprises a guidance structure disposed in the hoistway, and at least two guiding devices disposed on the elevator car, and configured to engage the guidance structure and thereby direct the course of travel of the elevator car.

3. The elevator system of claim 2, wherein the first direction is opposite of the second direction.

4. The elevator system of claim 3, wherein the first braking device is operably coupled to at least one side of the elevator car adjacent to the first braking surface, and the second braking device is operably coupled to at least one side of the elevator car adjacent to the second braking surface.

5. The elevator system of claim 4, wherein the first braking device comprises at least one of a retainer member, and a braking pad disposed on the retainer member.

6. The elevator system of claim 5, wherein the first braking surface comprises at least one of a first side of the guidance structure and the hoistway structure.

7. The elevator system of claim 6, wherein the second braking device comprises at least one of a retainer member, and a braking pad disposed on the retainer member.

8. The elevator system of claim 7, wherein at least one of the first braking device and the second braking device is disposed on at least one of an upper portion and a lower portion of the elevator car.

9. The elevator system of claim 7, wherein the second braking surface comprises at least one of the first side of the guidance structure, a second side of the guidance structure, and the hoistway structure, wherein the second side is opposite of the first side.

10. The elevator system of claim 2, wherein the at least two guiding devices are disposed on opposite sides of the elevator car.

11. The elevator system of claim 2, wherein the at least two guiding devices are disposed on the same side of the elevator car.

12. The elevator system of claim 2, wherein the guidance occurrence comprises at least one of the guiding devices becomes disengaged with the guidance structure, failure of the guidance structure, and the elevator car rotating beyond a guidance limit.

13. The elevator system of claim 1, wherein a first axis normal to the first braking surface is perpendicular to the rotation axis and a second axis normal to the second braking surface is perpendicular to the rotation axis.

14. An elevator system comprising:

a hoistway; and an elevator car disposed in the hoistway, the elevator car comprising:

a first braking device configured to engage a first braking surface in a first direction in the event of a guidance occurrence; and a second braking device configured to engage a second braking surface in a second direction in the event of the guidance occurrence;

wherein the hoistway comprises a hoistway structure, and the elevator system further comprises a guidance structure disposed in the hoistway, and at least two guiding devices disposed on the elevator car, and configured to engage the guidance structure and thereby direct the course of travel of the elevator car;

wherein the first direction is opposite of the second direction;

wherein the first braking device is operably coupled to at least one side of the elevator car adjacent to the first braking surface, and the second braking device is operably coupled to at least one side of the elevator car adjacent to the second braking surface;

wherein the first braking device comprises at least one of a retainer member, and a braking pad disposed on the retainer member;

wherein the first braking surface comprises at least one of a first side of the guidance structure and the hoistway structure;

wherein the at least two guiding devices comprise a first propulsion device.

15. The elevator system of claim 14, wherein the second braking device is operably coupled to the first propulsion device.

16. The elevator system of claim 15, wherein the second braking device comprises a braking pad.

17. The elevator system of claim 15, further comprising a second propulsion device disposed in the hoistway, wherein the second propulsion device is configured to engage the first propulsion device to direct movement of the elevator car.

18. The elevator system of claim 17, wherein the second braking surface comprises the second propulsion device.

* * * * *